United States Patent [19]

Smolyanitsky et al.

[11] Patent Number: 4,487,273

[45] Date of Patent: Dec. 11, 1984

[54] GRIPPING TOOL ADAPTED FOR USE WITH DEVICE FOR DRIVING ROD-SHAPED ELEMENTS INTO AND OUT OF THE GROUND

[75] Inventors: Boris N. Smolyanitsky; Vladimir P. Boginsky; Vladimir P. Gileta; Jury N. Syryamin; Alexei D. Terskov, all of Novosibirsk, U.S.S.R.

[73] Assignee: Institut Gornogo Dela, Novosibirsk, U.S.S.R.

[21] Appl. No.: 469,576

[22] Filed: Feb. 24, 1983

[51] Int. Cl.[3] ..... E21B 1/00

[52] U.S. Cl. ..... 173/55; 173/148; 173/53

[58] Field of Search ..... 173/53–56, 173/148–151; 72/431–440; 279/19, 19.4, 19.6, 19.7

[56] References Cited

U.S. PATENT DOCUMENTS 330,489 11/1885 Hussey ..... 173/53

FOREIGN PATENT DOCUMENTS 3026861 2/1982 Fed. Rep. of Germany ..... 173/53

775229 10/1980 U.S.S.R. ..... 173/53

*Primary Examiner*—James M. Meister

*Assistant Examiner*—John M. Knoble

*Attorney, Agent, or Firm*—Burgess, Ryan & Wayne

[57] ABSTRACT

A distinguishing feature of the present invention comprising a shell with side ports and an axial taper through cavity whose generatrix is inclined to the shell center line at an angle of less than the self-wedging angle, spring-biased gripping jaws accommodated in that cavity, levers installed in the shell ports and interacting by their inner ends with the gripping jaws consists in that the gripping tool is equipped with an abutment sleeve having an inside annular recess and installed on the shell external surface and a rubber shock absorber disposed between the recess upper surface and the outer ends of the levers.

3 Claims, 3 Drawing Figures

GRIPPING TOOL ADAPTED FOR USE WITH DEVICE FOR DRIVING ROD-SHAPED ELEMENTS INTO AND OUT OF THE GROUND

The present invention relates to construction engineering and more particularly, to gripping tools adaptable to devices for driving rod-shaped elements into and out of the ground.

The invention can be used for driving into the ground rod-shaped elements whose cross section is small as compared to their length. The present invention will be most useful for driving in flexible rod-shaped elements, such as grounding electrodes, anchor piles, probes, etc.

Known in the art is a gripping tool adaptable to a device for driving grounding electrodes into the ground and comprising a shell with a through taper cavity accommodating gripping jaws and springs maintaining a continuous contact of the gripping jaws with the shell and the electrode being driven in. The known gripping tool can operate in conjunction with a hydraulic power cylinder secured by clamps to the mast of an electric transmission line. When the service fluid is fed into the upper space of the cylinder, the piston goes down forcing the electrode into the ground. As the piston reaches the lowermost position, the fluid starts entering the lower space and raises the piston together with the gripping tool to the initial uppermost position.

The known gripping tool is rigidly fixed to the hydraulic cylinder piston hollow rod and imparts the driving load to the electrode due to a self-wedging effect taking place between the electrode and gripping tool in the course of the downward movement of the cylinder hollow rod. The arising ground reaction force acting on the hydraulic cylinder shell is taken up by the electric transmission line support to which the cylinder shell is clamped.

As the gripping tool reaches the ground surface, the fluid starts flowing into the lower space of the hydraulic cylinder. As a result, the gripping tool releases the electrode and goes up together with the cylinder rod to the initial position, moving relative to the motionless electrode held by the ground friction and to the cylinder shell fixed to the electric transmission line support.

After the piston rod together with the gripping tool reaches the uppermost position the fluid is supplied by the control slide valve into the upper space of the cylinder. As a result, the piston and rod rigidly fixed with the gripping tool starts moving down. The electrode is jammed by the self-wedging gripping tool and is forced into the ground to a depth equal to the travel of the hydraulic cylinder piston. The cycle is further repeated until the electrode is driven into the ground completely.

A disadvantage of the prior art gripping tool resides in that it can transmit force in one direction only, towards the tool shell taper cavity large-diameter side, i.e. in the driving-in direction. The static nature of the load applied renders it impossible to use the gripping tool with percussion and vibration mechanisms characterized, as it is known, by the action of alternating recoil forces and requiring a fixed joint between the rod-shaped element and gripping tool in the driving-in process.

Another prior art gripping tool in intended for driving rod-shaped elements into the ground by means of a vibrator. Located inside the shell of the known gripping tool are two taper bushes disposed opposite to each other by their small-diameter end faces. Spring-biased balls serving as jamming elements and separated by two cages (upper and lower ones) are placed into the taper cavities of the taper bushes. The upper cage is pinned to one end of a rocker arm whose opposite end is loaded by springs retained in seats and is connected with the cable of a hoisting device.

The rocker arms of the gripping tool connected with the movable vibrator bear against the weights fastened to the cables. The springs are compressed to a degree corresponding to the rocker arm end travel, while the upper cage and the balls contained in the upper taper bush are in the uppermost position, in which case the gripping tool is disengaged. The rod to be driven in is inserted through the bore in the vibrator and through the gripping tool. As the weight cables are relieved of tension the gripping tool jams the rod under the action of the vibrator gravity and the forces of the springs maintaining the balls through the cage so that they are wedged between the bush taper surface and the rod. Under these conditions the balls of the lower taper bush impart the applied driving-in force to the rod, while the balls of the upper taper bush keep the rod jammed due to the vibrator reaction force, thereby precluding displacement of the gripping tool over the rod downward or upward, respectively.

As the vibrator is put into action, the rod starts penetrating into the ground, and the vibrator with the gripping tool jammed with the rod moves down towards the ground surface. As soon as the gripping tool reaches the ground surface the hoisting device is switched on to disengage the gripping tool and raise the tool together with the vibrator to the initial position. In this case the rocker arms shift the upper cage upward and the rod gets released.

Disadvantages of the known gripping tool consist in a complex construction, large size and weight and in the necessity for using a hoisting device to release the rod and reset the rod driver to the initial position.

Also known in the prior art is a gripping tool for a device intended to drive into the ground rod-shaped elements, whose cross section is small in comparison with their length, comprising a shell with a through axial taper cavity accommodating spring-biased gripping jaws. Provided on the external surface of the shell are lugs with holes for pivot pins on which levers are installed with one end of each lever free and the opposite end thereof passed through one of the ports made in the shell side walls. The inner ends of the levers interact with the gripping jaws. The shell taper surface generatrix is inclined to the taper centre line at an angle less than the self-wedging angle, which makes it possible to wedge the rod between the gripping jaws under the action of the impact load and hence to engage the gripping tool. In this case the axial component of the rod wedging force is much greater than the recoil force of the rod driver. Therefore, the rod driver is firmly fixed to the rod and both move down together in the driving-in process.

As the rod driver approaches the ground and the free ends of the levers touch the ground surface, the levers rock on their pivot pins to shift the gripping jaws downward by their inner ends, thus increasing the distance between the jaws and releasing the rod. The gripping tool is now disengaged.

A disadvantage of this known gripping tool consists in an instability of its disengagement in the course of driving rod-shaped elements into the ground featuring an irregular surface or soft ground. This is attributed to the fact that in approaching an irregular ground surface the levers may fail to reach the ground simultaneously. It may happen that one lever is brought in contact with the ground surface already and shifts its gripping jaw downward, whereas another lever is still off the ground allowing its gripping jaw to remain in place. Such operation of the gripping jaws brings about cocking of the rod, premature and abnormal disengagement or, on the contrary, impeded disengagement of the gripping tool. Similar malfunctions take place in driving a rod into a soft ground, in which case one lever may penetrate deeper into the soil than another, at the same time failing to move its gripping jaw downward. Besides, the inopportune disengagement of the gripping tool may lead to its penetration somewhat into the ground and likely will result in an ingress of soil particles into the tool working zone. All the above stated adversely affects the serviceability of the gripping tool and in the final result reduces the rod driving rate.

Another disadvantage of the known gripping tool resides in its small service life, since its critical parts, such as pivot pins, lugs and levers are subjected to high dynamic loads at the instant the gripping tool gets disengaged and therefore frequently fail in operation.

The main object of the present invention is to provide a gripping tool which is promptly and duely disengaged, when driving rod-shaped elements into soils with irregular surface or soft ground in particular.

Another object of the invention is to eliminate stress concentration in the gripping tool component parts with the aim of improving the reliability and enhancing the durability of the tool.

In accordance with these and other objects the invention resides in that in a gripping tool adapted for use with a device for driving rod-shaped elements into or out of the ground and comprising a shell with side ports and an axial taper through cavity, whose generatrix is inclined to the shell centre line at an angle less than the self-wedging angle, spring-biased gripping jaws arranged inside the cavity, levers inserted into the shell side ports and interacting with the gripping jaws at their inner ends, according to the invention, there is an abutment sleeve having an annular inside recess and mounted on the external surface of the shell and a rubber shock absorber disposed between the recess upper surface and the outer ends of the levers.

In one embodiment of the invention relating to the known gripping tools provision is made for gripping elements made in the form of two-step rams installed in inclined guide grooves milled in the shell parallel to the inside taper cavity generatrix. The inner ends of the levers are forkshaped to straddle the small-diameter step of each gripping jaw.

In another embodiment of the invention, the inclined grooves and gripping jaws are essentially cylindrical in shape, with flats made throughout the length of the small-diameter step of each gripping jaw.

Such embodiments of the gripping tool make it possible to achieve higher stability in disengagement, improve reliability and enhance durability of the tool.

The essence of the proposed invention consists in ensuring simultaneous operation of the actuating levers in the course of driving rod-shaped elements into the ground with an irregular surface by means of an abutment sleeve which displaces upward in the axial direction relative to the gripping tool shell and acts upon the outer ends of all the levers simultaneously after the sleeve bottom surface or even part of it bears against the ground. As a result, the inner ends of the levers shift all the gripping jaws down in concert and disengage the gripping tool, thus precluding cocking and binding of the gripping jaws likely to occur in case of an asynchronous operation of the levers.

What is more, the greater bearing surface of the abutment sleeve ensures a dependable displacement of the sleeve relative to the shell when rod-shaped elements are driven into soft ground.

In consequence of this feature a high stability in disengagement of the gripping tool is attained and ingress of soil particles into the tool is excluded.

To increase the contact area between the gripping jaws and shell, inclined guide grooves are made in the shell, and the gripping jaws are made in the form of two-step rams installed in these grooves. Contact compression stresses are thus reduced with a resultant increase in the service lives of the shell and gripping jaws.

The gripping tool shell and levers are simple in configuration to avoid stress concentration, which also adds to the reliability and service life of the tool.

The use of the alleged invention allows the rod driving capacity to be increased by 1.5–2.0 times owing to a higher stability of the tool disengagement process and the service life of the construction to be doubled or even trebled.

Other objects and attendant advantages of the present invention will become apparent to those skilled in the art from the following detailed description of several preferred embodiments of the invention given by way of example with reference to the accompanying drawings, in which.

Figure 1:
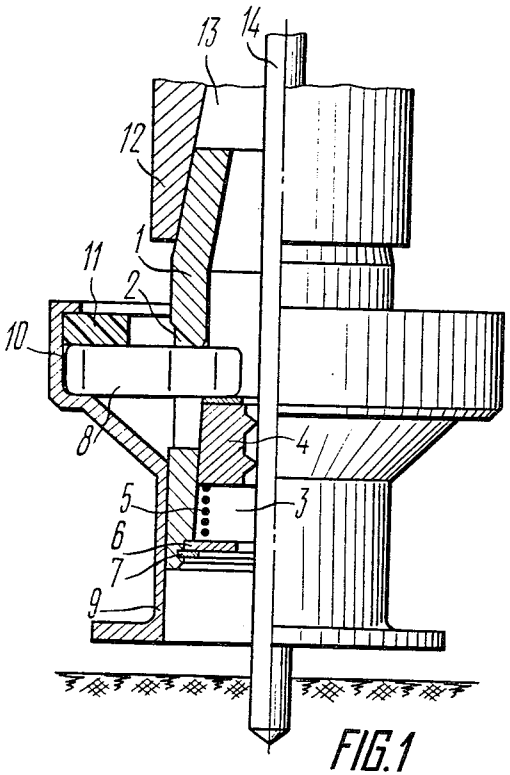
FIG. 1 illustrates schematically the gripping tool of a device for driving rod-shaped elements into and out of the ground, according to the invention.

The gripping tool (FIG. 1) adapted for use with a device for driving rod-shaped elements into and out of the ground according to the invention comprises a shell 1 with side ports 2 and an axially disposed taper through cavity 3. Reciprocating axially inside the taper cavity 3 of the shell 1 are gripping jaws 4 each backed up by a spring 5 which rests on a plate 6 held in the shell 1 by means of a retaining ring 7. Clamping levers 8 are inserted into the ports of the shell 1 so that their inner ends are in contact with the jaws 4. An abutment sleeve 9 is fitted on the outside surface of the shell 1. It has an inside annular recess 10. The abutment sleeve is held against downward displacement by a rubber shock absorber 11 installed in the recess to rest on the outer ends of the clamping levers 8. The gripping tool shell 1 is connected with a rod driver, for instance, with a pneumatic percussion mechanism 12, having a through axial cavity 13 for passing the rod 14 to be driven in.

The gripping tool functions as follows. The rod driver, for instance, the pneumatic percussion mechanism 12 complete with the gripping tool is put in a vertical position on the ground surface. The abutment sleeve 9 thrust against the ground by its bottom flange moves relative to the shell 1 upwards, pressing the clamping levers 8 which shift the jaws 4 downward, thereby increasing the space between the jaws.

The rod-shaped element 14 is passed from above through the rod driver 12 and gripping tool to bear against the ground surface. Then, holding the rod-shaped element 14 pressed against the ground, the rod driver 12 is set to the initial position together with the gripping tool at a height of 0.5–0.7 m from the ground surface. The gripping jaws 4 are moved by the springs 5 to the upper position to make contact with the rod 14. Under the effect of gravity the rod driver 12 makes the gripping jaws 4 clamp the rod 14 firmly, thereby preventing the rod driver 12 from slipping down along the rod 14. After the rod driver 12 is put into action, the blows dealt by the rod driver striker are conveyed to the gripping tool shell 1 which tends to move downward. As a consequence, the gripping jaws 4 clamping the rod 14 slip a bit relative to the taper surface of the cavity 3 and move closer together accordingly, thereby wedging the rod 14. The gripping tool is now engaged. The recoil action of the pneumatic percussion mechanism 12 tends to move the mechanism together with the gripping tool over the rod 14 upward. However, the recoil forces are insufficient for disengagement of the gripping tool, therefore the gripping tool cannot move relative to the rod-shaped element.

Under the effect of the blows dealt to the shell the rod 14 moves downwards together with the pneumatic percussion mechanism 12 and gripping tool firmly clamped with the rod. The latter penetrates into the ground.

As the gripping tool approaches the ground surface, its abutment sleeve 9 reaches the ground and stops moving. The gripping tool shell 1 still continues to move relative to the abutment sleeve 9 and presses the inner ends of the levers 8 by the upper edges of the ports 2. Since the outer ends of the levers 8 thrust against the motionless abutment sleeve 9 at that time, the inner ends of the levers 8 make the gripping tool jaws 4 shift downward relative to the taper surface of the cavity 3 in the shell 1 with a resultant increase in the distance between the jaws and their separation from the rod 14. The gripping tool gets disengaged.

Under the effect of the recoil force of the pneumatic percussion mechanism 12 the mechanism proper and gripping tool released from the rod 14 are shifted as a unit upward over the rod 14 to a height of 0.3–0.5 m from the ground surface. The next blow of the striker rejams the rod 14 in the gripping tool and the driving-in process is resumed. The above described cycle reiterates until the rod is driven in as required.

Therefore, the described gripping tool permits driving in the rod-shaped elements with the use of percussion or vibration mechanisms, providing a high and long-term stability of the engagement and disengagement processes.

Another exemplary embodiment of the present invention is a gripping tool (FIGS. 2 and 3) of a device for driving rod-shaped elements into and out of the ground, comprising a shell 1 with ports 2 in the side wall and a through coaxially arranged taper cavity 3. Milled in the shell 1 are inclined guide grooves 15 intended to receive gripping jaws 4 which are made in the form of two-step rams each backed up by a spring 5 resting on a plate 6. The plate 6 is held in the shell 1 by a retaining ring 7. Clamping levers 8 are inserted into the ports 2 in the shell 1. The inner ends of the levers 8 are fork-shaped to span the small-diameter step of each gripping jaw 4. An abutment sleeve 9 having an inside annular recess 10 is fitted on the external surface of the shell 1. The abutment sleeve 9 is supported by the rubber shock absorber 11 installed in the recess 10 to rest on the outer ends of the clamping levers 8. In the exemplary embodiment the gripping jaws 4 and slant grooves 15 according to the invention are essentially cylindrical. Flats 16 are made on the external surface of the small-diameter step of each gripping jaw 4. The shell 1 of the gripping tool is connected with the rod driver, for instance, with a pneumatic percussion mechanism 12 having a through axial cavity 13 for passing the rod 14 to be driven in.

It is expedient that such variant of the gripping tool be used for driving rod-shaped elements into compact and frozen soils. High jamming forces arising under such conditions do not cause high compressive stresses in the gripping jaws and tool shell due to a greater contact area between them.

Figure 2:
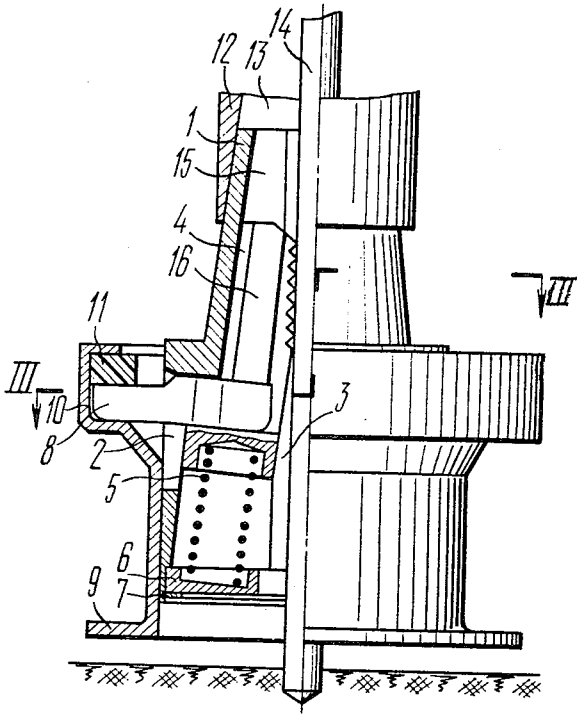
FIG. 2 illustrates another embodiment of the gripping tool with gripping jaws, according to the invention, made in the form of two-step rams reciprocating in slant guide grooves milled in the shell.
Figure 3:
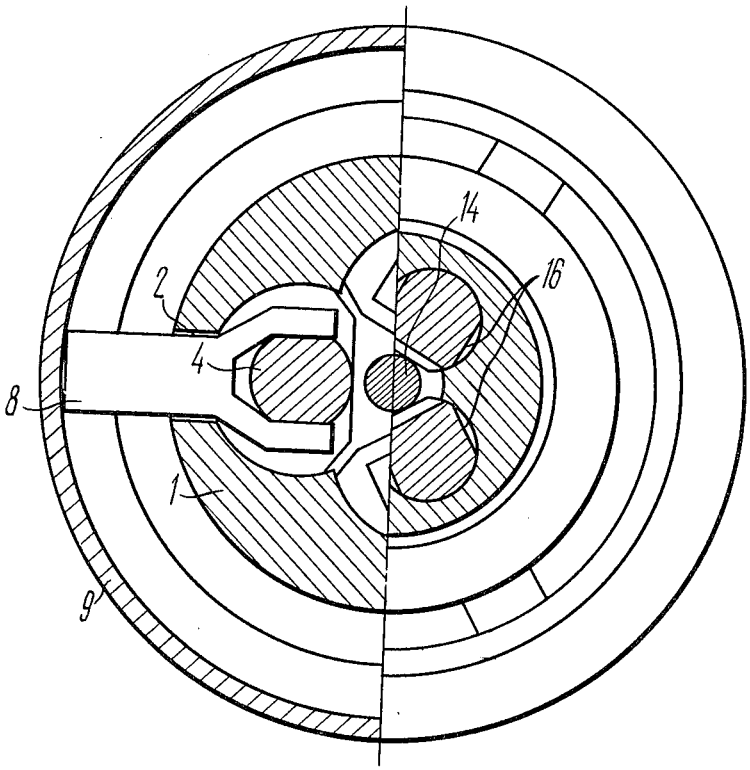
FIG. 3 is a section taken along the line III—III in FIG. 2.

The operation of the gripping tool shown in FIGS. 2 and 3 differs from that of the first variant in the following.

As the gripping tool approaches the ground surface and the bottom surface of the abutment sleeve 9 contacts the ground, the sleeve stops moving. The gripping tool shell 1 still continues to move downward and presses the inner ends of the levers 8 by the upper edges of the ports. Since the outer ends of the levers 8 thrust against the motionless abutment sleeve 9, the fork-shaped inner ends of the levers 8 straddling the small-diameter steps of the gripping jaws 4 move downward, shifting the large-diameter steps respectively. As a result, the distance between the jaws increases, the gripping tool gets disengaged and the rod is released.

In all other respects the operating principle is similar to that described above.

The gripping tool adapted for use with a device for driving rod-shaped elements into the ground, according to the invention, permits driving in the rod-shaped elements by applying an axial driving load to the rod side surface, automatic repositioning of the rod driver over the rod, as the latter penetrates into the ground, by utilizing the driving and recoiling effects.

As distinct from the known rod driver gripping tools, the tool according to the present invention is reliable and durable in operation and ensures a high and long-term stability of the engagement and disengagement processes.

What is claimed is:

1. A gripping tool adapted for use with a device for driving rod-shaped elements into and out of the ground comprising a shell with side walls; ports made in the side walls of said shell; an axial taper through cavity made inside said shell with the generatrix forming an angle with the shell centre line less than the self-wedging angle; spring-biased gripping jaws accommodated inside said taper cavity; levers inserted into said ports and interacting by their inner ends with said gripping jaws; an abutment sleeve having an inside annular recess and installed on the external surface of said shell; a rubber shock absorber disposed between the upper surface of said recess and the outer ends of said levers.

2. A gripping tool for a device according to claim 1, in which said gripping jaws are made in the form of two-step rams installed in inclined guide grooves milled in said shell parallel with the generatrix of said taper cavity and the inner ends of the levers are fork-shaped to straddle the small-diameter step of each of said gripping jaws.

3. A gripping tool for a device according to claim 2, wherein said inclined grooves and gripping jaws are essentially cylindrical in configuration, being provided with flats milled throughout the length of the small-diameter step of each gripping jaw.

* * * * *